United States Patent [19]

Feess

[11] Patent Number: 4,602,914

[45] Date of Patent: Jul. 29, 1986

[54] PROCESS FOR PRINTING POLYESTER FIBER MATERIALS BY THE TRANSFER PRINTING TECHNIQUE: SEPARATE DOTS FOR INDIVIDUAL COLORS

[75] Inventor: Erich Feess, Hofheim am Taunus, Fed. Rep. of Germany

[73] Assignee: Hoechst Aktiengesellschaft, Fed. Rep. of Germany

[21] Appl. No.: 550,744

[22] Filed: Nov. 10, 1983

[30] Foreign Application Priority Data

Nov. 13, 1982 [DE] Fed. Rep. of Germany ..... 3242154

[51] Int. Cl.[4] ..... D06P 3/52; B41M 5/26

[52] U.S. Cl. ..... 8/471; 8/444; 8/478; 8/485; 8/922; 156/234

[58] Field of Search ..... 8/470, 471, 485; 156/234

[56] References Cited

U.S. PATENT DOCUMENTS

| | | | |
|---|---|---|---|
| 2,708,647 | 5/1955 | Walsh | 156/234 |
| 3,432,376 | 3/1969 | Reed et al. | 156/234 |
| 3,564,131 | 2/1971 | Herold et al. | 101/395 |
| 4,057,864 | 11/1977 | Wild | 8/500 |
| 4,432,217 | 2/1984 | Ochsner | 68/5 D |

FOREIGN PATENT DOCUMENTS

| | | | |
|---|---|---|---|
| 50-997 | 1/1975 | Japan | 8/500 |
| 53-40308 | 4/1978 | Japan | 8/471 |
| 1376108 | 12/1974 | United Kingdom | 8/471 |

OTHER PUBLICATIONS

Field, J. ed. *Graphic Arts Manual,* Arno Press N.Y. 1980, pp. 317–320.

*Primary Examiner*—A. Lionel Clingman
*Attorney, Agent, or Firm*—Connolly and Hutz

[57] ABSTRACT

The textile-printing industry is very interested in bypassing the laborious and expensive production of transfer printing papers, together with the required engraving of rolls. It has been found that this demand can be satisfied by electronically recording and reproducing any motif and transferring to textile material by means of halftone systems.

According to the invention, the dyestuffs are continuously transferred by halftone systems from four differently and uniformly colored papers one after the other. To obtain a good picture, 10 to 20 halftone dots per cm are advisable for pressing the paper to the surface of the textile material. Either the halftone dots themselves are heated, or they press the textile material and paper onto a heated surface. The halftone dots are electronically actuated in correspondence with the scanning of the motif.

The process can be carried out particularly simply on a flat screen printing machine, because this machine dispenses with the need to perform the color transfer very rapidly from the paper uniformly colored with dyestuff to the PES material.

4 Claims, 2 Drawing Figures

Figure 1:
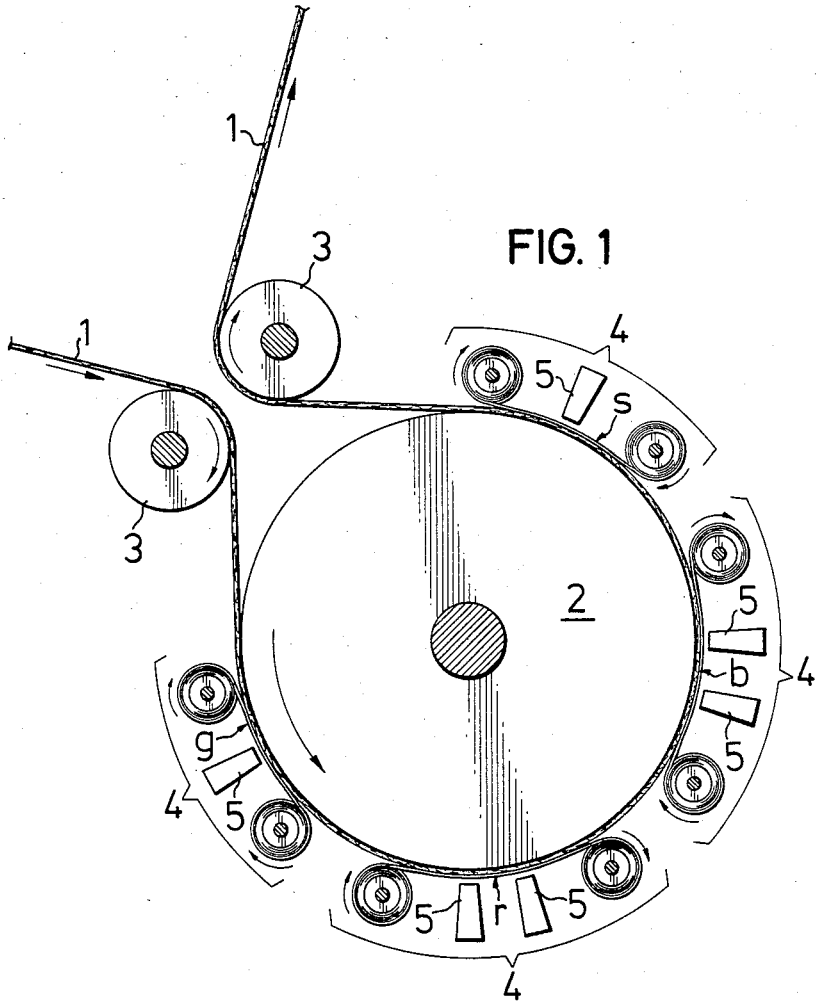

PROCESS FOR PRINTING POLYESTER FIBER MATERIALS BY THE TRANSFER PRINTING TECHNIQUE: SEPARATE DOTS FOR INDIVIDUAL COLORS

The present invention concerns the fixing of sublimable dyestuffs which can be applied to polyester fiber material web by a continuous or semi-continuous transfer printing method.

It is known to print textile synthetic fiber webs by transfer printing processes. The principle of transfer printing is to bring color carriers which have been printed beforehand with sublimable dyestuffs into contact with the web to be printed while, at the same time, applying heat. As a result the dyestuffs sublime from the color carrier (transfer paper) to the textile material, where they become fixed. Transfer printing has the advantage that even relatively small textile businesses can produce prints on synthetic fiber textiles, namely in that they themselves print the fiber material on simple machines with ready-printed transfer carriers. However, each pattern on the transfer carrier has to be separately prepared beforehand by etching a printing roll and making color blocks.

Now, there is a reproduction process in which a colored picture is transferred by an electronically controlled and heated halftone system, by means of four papers uniformly covered with the primary printing colors, onto paper bearing a layer which has an affinity for dyestuff. Since the four papers are scanned in succession by the electronic control system, the reproduction of a small area takes a long time. Reproduction, either directly from an original or by means of stored video signals, can therefore only take place discontinuously.

It is the object of the present invention to provide a continuous or semicontinuous transfer printing process for textile webs where there is no need to engrave the rolls and where it is possible to change the printing motif within a short time.

This object is achieved by continuously or semicontinuously transferring sublimable dyestuffs from several differently colored transfer carriers which are each uniformly covered with the respective printing color and are directly one behind the other, by means of heated variable halftone systems which consist of at least one row of halftone dots which extends transversely across the transport path of the forward-moving textile fabric and which are actuated in accordance with a program initiated at an information source, by pulses which have been separately assigned to each individual point in the form of a pattern, to the surface of the textile synthetic fiber material web moving past, in line with the pattern to be formed.

The halftone systems used according to the invention can consist of mechanically mobile halftone dots which are close to one another. However, it is also possible to mount these individual halftone dots as separately rapidly heatable dots on a roll. The information source for indicating the sequence in which the halftone dots are to be actuated can be, for example, punched tapes, magnetic tapes or the like, into which the necessary data have been entered. It is very particularly advantageous to control the individual halftone dots by video signals which are either directly recorded and transmitted from the colored original of the motif or recalled from electronic storage systems.

Transfer printing is done as follows using the novel process: a first color transfer carrier which is completely covered with transferable dyestuff is brought into contact with the textile material. A heated halftone system is ordered in such a way by electronic signals (for example a video color signal) that it corresponds to a line of the color component of the original. Printing then takes place on the transfer carrier and textile material in the course of a short period, the heated halftone system causing the dyestuff to transfer from the color carrier to the textile material. The further lines are then scanned in the same way, and each time a corresponding print is produced on the continuously moving textile material. In this way a complete picture of the first chromatic component is obtained.

Immediately thereafter the second color component is transferred in register by means of the second color transfer carrier and a second halftone device. In this way all three primaries (yellow, red and blue) and possibly also black or dark gray are transferred in the course of one transfer. However, four colors requires four halftone devices.

In one version of the process, the halftone systems are not heated but, instead, press the transfer carrier and the textile material onto a heated plate. In this case, however, the outlines are not quite as crisp as with the heated halftone system.

It is extremely simple to change the motif, since it is only necessary to exchange either the original in front of the viewing camera or the controlling information carrier.

Satisfactory picture reproduction of the type customary in the production technology requires about 25 halftone dots per 1 cm. In thermal transfer printing, very good results can be obtained with 10 to 20 halftone dots per cm. For sufficiently fast production and when the patterns need not be excessively fine, 3, in special circumstances even 2, halftone dots per cm are adequate.

The process claimed in the invention can be carried out not only continuously but also semicontinuously:

With the continuous procedure, the halftone system generally consists of a single row of halftone dots which are controlled by a video signal line and, within a few milliseconds, their temperature effects the transfer of the dyestuff from the transfer carrier to the textile material. This row of halftone dots, which extends over the entire width of the web to be printed, is also referred to as a halftone bar. 2, exceptionally even 3, halftone bars can be present at one time for one color. The halftone systems are directly actuated either mechanically or electronically. The halftone bars can even be equipped to be pivotable in the direction of the moving web. On each electronic actuation of the individual halftone systems the entire bar pivots, together with the halftone systems, with the speed of the web and thereby permits more prolonged and more intensive application of heat to the color carrier. As a result the formation of lines—instead of dots—is avoided, and a higher web speed becomes possible. Since the primary colors are transferred immediately one after the other, the motif being transferred is continuously formed on the textile material.

Figure 2:
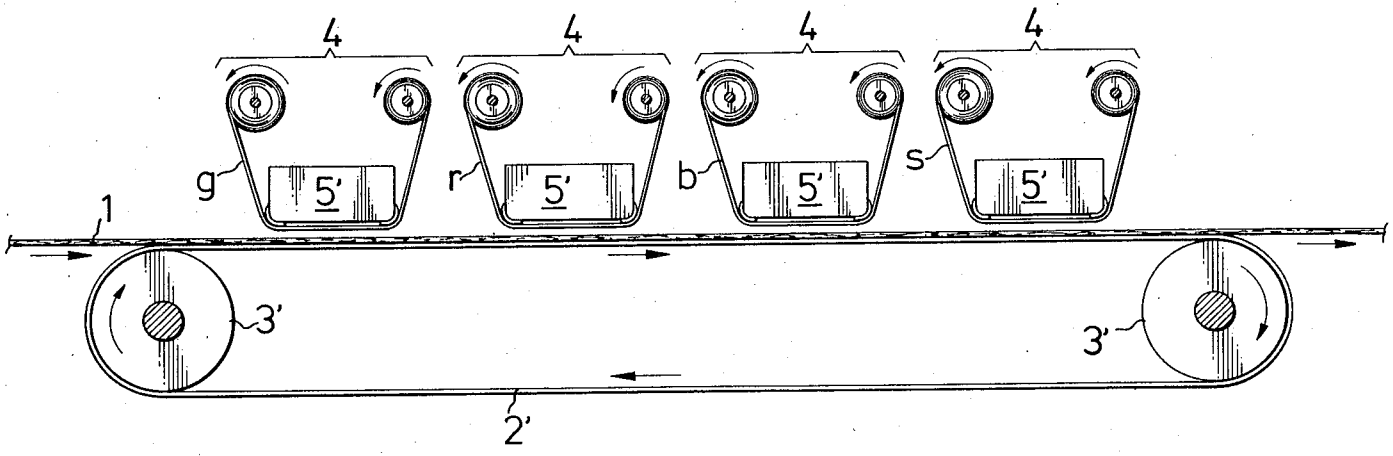

FIG. 1 is a diagrammatic view illustrating transfer printing according to the present invention. And FIG. 2 is a diagrammatic view illustrating an alternate embodiment of transfer printing according to the present invention.

The present invention will now be illustrated in more detail by reference to drawings:

In FIG. 1, a textile web (1) is guided, via guiding rolls (3), about a drum (2) about which four color carriers, in the present case the thermopapers yellow (g), red (r), blue (b) and black (s), have been arranged in separate unwinding devices (4). The halftone bars (5) with the halftone dots therein have been arranged, either in singles or pairs, above the papers. On command the heated dots press very rapidly, as desired and programmed, onto the color carrier and cause the dyestuff to sublime to the textile material at this spot, to form, depending on the pattern, one or, by the actuation of several halftone dots, more colored dots.

It is also possible to arrange the halftone dots in the form of a drum or a semicircular trough in place of a bar arrangement. The arrangement will initially depend on the chosen size of halftone area. It is furthermore also possible to equip the halftone bars to be pivotable: on each electronic actuation of the individual halftone dots the entire bar pivots with the fabric speed and thereby enables longer and more intensive application of heat to the paper, permitting, as already mentioned, a higher fabric speed.

In the semicontinuous procedure, the halftone system comprises several halftone panels which transfer a whole color component to the textile material moving in repeat-sized steps. The arrangement can be mounted on a screen-printing machine where the transfer carrier and the material to be printed likewise move forward in repeat-sized steps.

A flat screen printing machine is most suitable for this process. A machine of this type offers sufficient space to instal halftone systems, irrespective of whether these systems take the form of bars or whole panels. In addition, it is perfectly feasible to reequip existing flat screen printing machines for the new process. Moreover, the way in which, and the speed at which a flat screen printing machine works allows the halftone systems to scan an entire color area, depending on the motif, and, in so doing, to transfer the dyestuff. The four colors yellow, red, blue and black are side by side on the printing table, like screen-printing stencils, and the scanning can take place whenever the printing machine stops.

FIG. 2 is a sketch to illustrate the semicontinuous procedure in more detail. (1) denotes the textile material, and (2') denotes the endless printing cloth which is guided and moved along by the guide rolls (3'). The unwinding rolls (4) with the various color papers (g, r, b and s) have been arranged above the printing cloth. (5') indicates the halftone panels for the patterning.

The inventive idea underlying the process, described above, for producing printed patterns is to work without engraved rolls and even without premanufactured, stamped or etched moldings. There is no need for any time-consuming preliminary work, and a motif can thus be transferred extremely quickly.

However, this does not mean that it is impossible to use such shapes and figures, advantageously in the form of small and simple metal castings (crosses, rhomboids, circles, squares, hearts and the like) in the manner of the abovementioned process, i.e. to use them instead of the halftone dots.

Either they are heated like the halftone dots, or they press onto a heated surface. It is also possible to employ in this way variously shaped grids, fine or coarse, composed of connected rings, irregular circles, rectangles and squares.

I claim:

1. In a process for printing polyester fiber material webs with sublimable dyestuffs by a continuous or semicontinuous transfer printing method wherein separate color carriers covered with sublimable dyestuffs are brought into contact with a moving web to be printed while heat is applied thereto to cause subliming of the dyestuffs from the color carriers onto the web, the improvement of which comprises moving the web along a predetermined transport path, positioning separate color transfer carriers in a coordinated sequence one after the other in series along the transport path of the moving web, arranging each color transfer carrier across the transport path of the moving web, transferring color from the carriers by selectively engaging the separate color transfer carriers with distinct and discrete halftone dots arranged across the transport path of the moving web in at least one row for each color transfer carrier, and activating selected halftone dots from the at least one row thereof associated with each color tranfer carrier according to a program in a data source to thereby produce transferred unicolored dots in the form of a multi-colored pattern on the fiber material web.

2. A process as in claim 1 wherein the step of transferring color from the carriers to the fiber material web includes selectively heating the distinct and discrete halftone dots associated with each color carrier according to the program in the data source.

3. A process as in claim 1 wherein the step of transferring color from the carriers to the fiber material web includes selectively pressing the distinct and discrete halftone dots associated with each color carrier according to the program in the data source, the passing being onto the fiber material web against a heat source.

4. A process as in claim 1 wherein the data source comprises a multi-colored pattern recorded by a video camera.

* * * * *